US010533276B2

(12) United States Patent
Dunn

(10) Patent No.: US 10,533,276 B2
(45) Date of Patent: Jan. 14, 2020

(54) EXTENDABLE NOZZLE ASSEMBLY FOR A WASHING MACHINE APPLIANCE

(71) Applicant: Haier US Appliance Solutions, Inc., Wilmington, DE (US)

(72) Inventor: David Scott Dunn, Smithfield, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 171 days.

(21) Appl. No.: 15/670,003

(22) Filed: Aug. 7, 2017

(65) Prior Publication Data

US 2019/0040568 A1 Feb. 7, 2019

(51) Int. Cl.

| | |
|---|---|
| ***D06F 39/08*** | (2006.01) |
| ***B05B 12/00*** | (2018.01) |
| ***B05B 9/01*** | (2006.01) |
| ***D06F 39/02*** | (2006.01) |
| ***D06F 39/14*** | (2006.01) |
| ***D06F 39/00*** | (2006.01) |
| ***D06F 33/02*** | (2006.01) |
| ***D06F 23/04*** | (2006.01) |

(Continued)

(52) U.S. Cl.

CPC ..... *D06F 39/088* (2013.01); *B05B 9/01* (2013.01); *B05B 12/002* (2013.01); *B05B 15/62* (2018.02); *B05B 15/656* (2018.02); *B05B 15/70* (2018.02); *D06F 23/04* (2013.01); *D06F 33/02* (2013.01); *D06F 39/005* (2013.01); *D06F 39/022* (2013.01); *D06F 39/028* (2013.01); *D06F 39/14* (2013.01); *D06F 2202/12* (2013.01); *D06F 2204/088* (2013.01)

(58) Field of Classification Search

CPC ..... D06F 39/022; D06F 39/028; D06F 39/08; D06F 39/083; D06F 39/088; D06F 21/06; D06F 21/08; D06F 21/10; D06F 23/04; D06F 23/06

See application file for complete search history.

(56) References Cited

U.S. PATENT DOCUMENTS

| | | | | |
|---|---|---|---|---|
| 1,681,322 A | | 8/1928 | Cave | |
| 2,608,438 A | * | 8/1952 | McDonald | B05B 3/00 239/229 |

(Continued)

FOREIGN PATENT DOCUMENTS

| | | | | |
|---|---|---|---|---|
| CN | 103820967 A | | 5/2014 | |
| DE | 102009012950 A1 | * | 10/2009 | D06F 35/00 |

OTHER PUBLICATIONS

Machine Translation of Heinz, DE-102009012950-A1, Oct. 2009. (Year: 2009).*

*Primary Examiner* — David G Cormier

(74) *Attorney, Agent, or Firm* — Dority & Manning, P.A.

(57) ABSTRACT

A washing machine appliance includes a nozzle assembly for providing wash fluid to a tub of the washing machine appliance. The nozzle assembly includes an extendable nozzle mounted on the end of a retractable fluid supply conduit such as a telescoping arm or a folding arm. The retractable fluid supply conduit is movable for positioning the extendable nozzle in a retracted position and an extended position. The retractable fluid supply conduit is fluidly coupled to a valve assembly on the back of the washing machine appliance such that a user may extend the extendable nozzle to perform pretreating operations or otherwise selectively supply wash fluid to the tub.

20 Claims, 7 Drawing Sheets

(51) Int. Cl.

| | |
|---|---|
| ***B05B 15/656*** | (2018.01) |
| ***B05B 15/62*** | (2018.01) |
| ***B05B 15/70*** | (2018.01) |

(56) References Cited

U.S. PATENT DOCUMENTS

| | | | | |
|---|---|---|---|---|
| 2,712,746 | A | 7/1955 | Bochan | |
| 3,144,031 | A | 8/1964 | Long | |
| 4,349,154 | A * | 9/1982 | Pacht | B05B 1/30 239/124 |
| 5,857,362 | A * | 1/1999 | Oh | D06F 35/006 68/148 |
| 5,953,939 | A * | 9/1999 | Guerrero-Parra | D06F 23/04 68/23.2 |
| 6,240,586 | B1 * | 6/2001 | Joo | D06F 33/02 68/12.06 |
| 7,735,345 | B2 | 6/2010 | Wright et al. | |
| 2007/0067920 | A1 * | 3/2007 | Zaccone | D06F 25/00 8/158 |
| 2008/0186170 | A1 * | 8/2008 | Schleifer | A47L 15/0049 340/540 |
| 2016/0102425 | A1 * | 4/2016 | Scheckelhoff | D06F 29/00 68/13 R |

* cited by examiner

EXTENDABLE NOZZLE ASSEMBLY FOR A WASHING MACHINE APPLIANCE

FIELD OF THE INVENTION

The present subject matter relates generally to washing machine appliances and more particularly to nozzle assemblies for washing machine appliances.

BACKGROUND OF THE INVENTION

Washing machine appliances generally include a tub for containing water or wash fluid, e.g., water and detergent, bleach, and/or other wash additives. A basket is rotatably mounted within the tub and defines a wash chamber for receipt of articles for washing. During normal operation of such washing machine appliances, the wash fluid is directed into the tub and onto articles within the wash chamber of the basket. The basket or an agitation element can rotate at various speeds to agitate articles within the wash chamber, to wring wash fluid from articles within the wash chamber, etc.

During operation of certain washing machine appliances, a volume of wash fluid is directed into the tub in order to wash and/or rinse articles within the wash chamber. More specifically, a predetermined volume of wash fluid is typically provided through a stationary nozzle positioned at the center of the back wall of the washing machine appliance. However, in certain situations, a user may wish to have additional wash fluid dispensed into the tub and/or may wish to direct the flow of wash fluid onto a particular garment or within a specific region of the wash tub, e.g., to perform a pretreating operation, to saturate a particular article of clothing, or to accommodate an extra-large load. The ability to adjust the amount of water or wash fluid and its dispensing location is a commercially desirable feature and increases the user's positive perception of the wash process generally.

Accordingly, a washing machine appliance that provides a user with more control over the dispensing of wash fluid is desirable. In particular, a nozzle assembly that enables the dispensing of an additional amount of wash fluid at a desired location within the tub would be particularly beneficial.

BRIEF DESCRIPTION OF THE INVENTION

The present subject matter provides a washing machine appliance including a nozzle assembly for providing wash fluid to a tub of the washing machine appliance. The nozzle assembly includes an extendable nozzle mounted on the end of a retractable fluid supply conduit such as a telescoping arm or a folding arm. The retractable fluid supply conduit is movable for positioning the extendable nozzle in a retracted position and an extended position. The retractable fluid supply conduit is fluidly coupled to a valve assembly on the back of the washing machine appliance such that a user may extend the extendable nozzle to perform pretreating operations or otherwise selectively supply wash fluid to the tub. Additional aspects and advantages of the invention will be set forth in part in the following description, or may be apparent from the description, or may be learned through practice of the invention.

In one exemplary embodiment, a washing machine appliance is provided defining a vertical, a lateral, and a transverse direction. The washing machine appliance includes a cabinet; a tub positioned within the cabinet; and a wash basket rotatably mounted within the tub, the wash basket defining a wash chamber for receiving articles for washing. A nozzle assembly is mounted within the cabinet and configured to provide wash fluid to the tub. The nozzle assembly includes an extendable nozzle and a valve assembly configured to provide a flow of wash fluid to the extendable nozzle. A retractable fluid supply conduit provides fluid communication between the valve assembly and the extendable nozzle, the retractable fluid supply being movable for positioning the extendable nozzle in a retracted position and an extended position.

In another exemplary embodiment, a nozzle assembly for a washing machine appliance is provided. The washing machine appliance has a tub positioned within a cabinet and the nozzle assembly is mounted within the cabinet and configured to provide wash fluid to the tub. The nozzle assembly includes an extendable nozzle and a valve assembly configured to provide a flow of wash fluid to the extendable nozzle. A retractable fluid supply conduit provides fluid communication between the valve assembly and the extendable nozzle, the retractable fluid supply being movable for positioning the extendable nozzle in a retracted position and an extended position.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
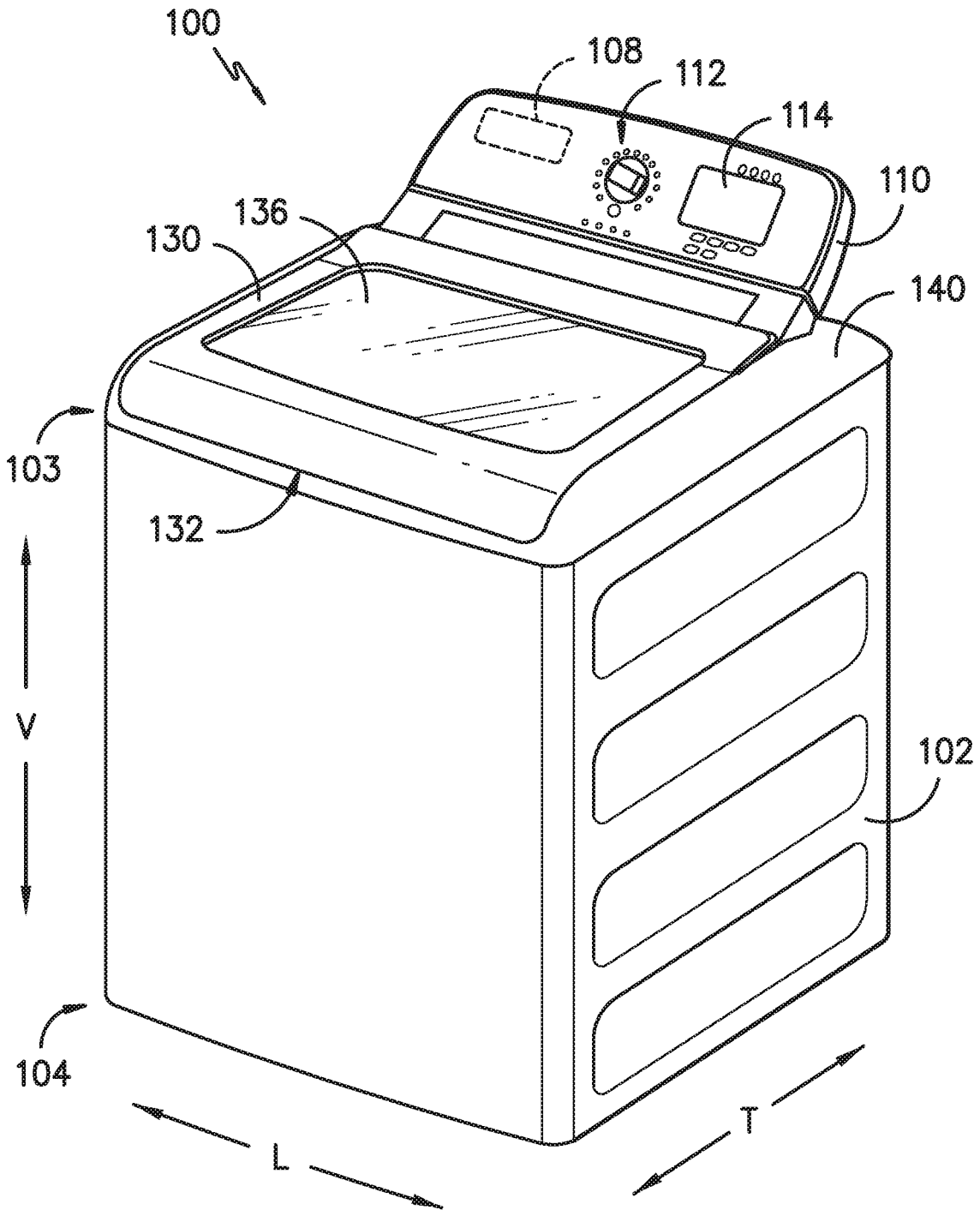
FIG. 1 provides a perspective view of a washing machine appliance according to an exemplary embodiment of the present subject matter with a door of the exemplary washing machine appliance shown in a closed position.

Repeat use of reference characters in the present specification and drawings is intended to represent the same or analogous features or elements of the present invention.

DETAILED DESCRIPTION OF THE INVENTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
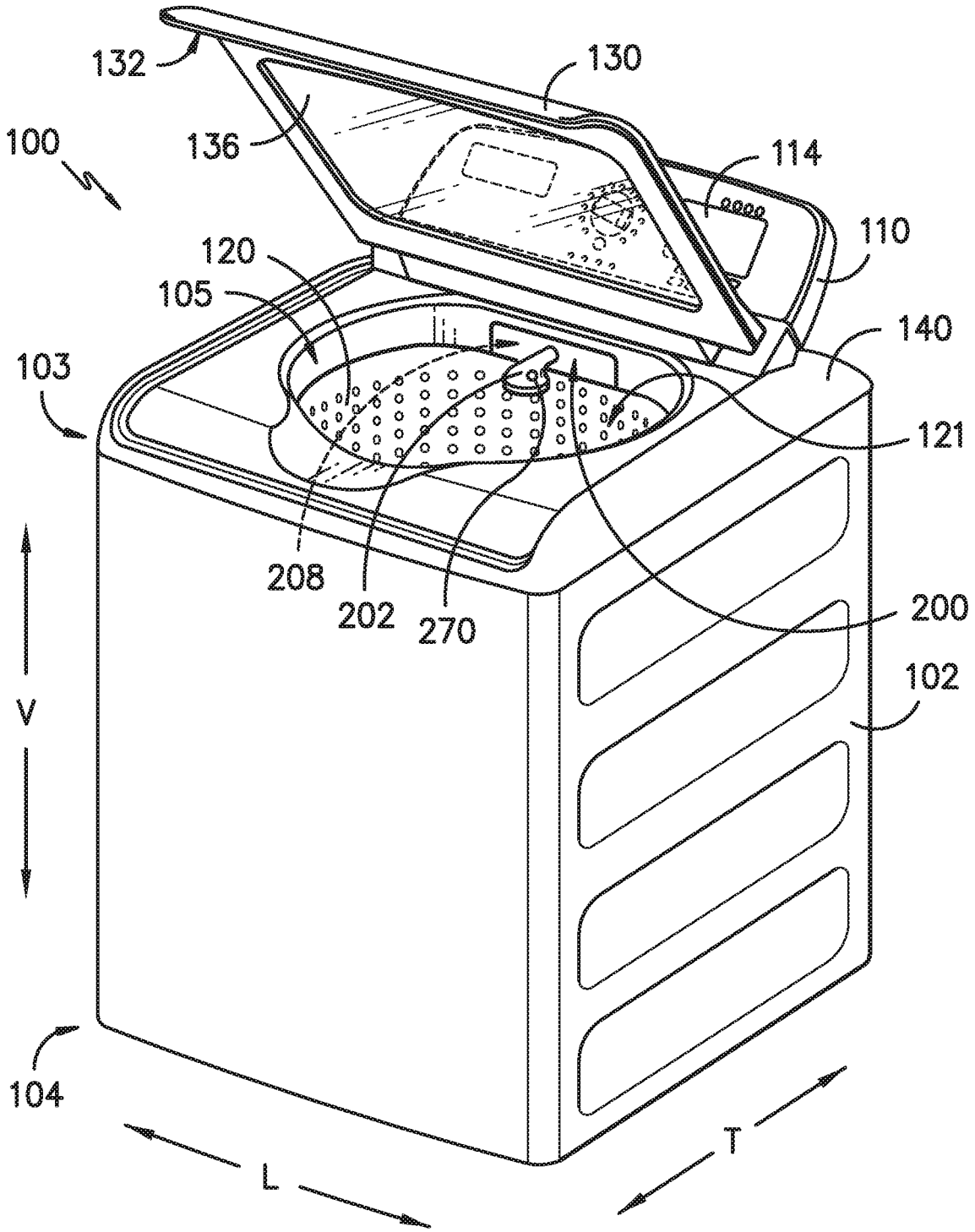
FIG. 2 provides a perspective view of the exemplary washing machine appliance of FIG. 1 with the door of the exemplary washing machine appliance shown in an open position.

FIGS. 1 and 2 illustrate an exemplary embodiment of a vertical axis washing machine appliance 100. In FIG. 1, a lid or door 130 is shown in a closed position. In FIG. 2, door 130 is shown in an open position. Washing machine appliance 100 generally defines a vertical direction V, a lateral direction L, and a transverse direction T, each of which is mutually perpendicular, such that an orthogonal coordinate system is generally defined.

While described in the context of a specific embodiment of vertical axis washing machine appliance 100, using the teachings disclosed herein it will be understood that vertical axis washing machine appliance 100 is provided by way of example only. Other washing machine appliances having different configurations, different appearances, and/or different features may also be utilized with the present subject matter as well, e.g., horizontal axis washing machines. Moreover, aspects of the present subject matter may be used in any other consumer or commercial appliance where it is desirable to control the dispensing of water or another fluid.

Washing machine appliance 100 has a cabinet 102 that extends between a top portion 103 and a bottom portion 104 along the vertical direction V. A wash basket 120 (FIG. 2) is rotatably mounted within cabinet 102. A motor (not shown) is in mechanical communication with wash basket 120 to selectively rotate wash basket 120 (e.g., during an agitation or a rinse cycle of washing machine appliance 100). Wash basket 120 is received within a wash tub or wash chamber 121 (FIG. 2) and is configured for receipt of articles for washing. The wash tub 121 holds wash and rinse fluids for agitation in wash basket 120 within wash tub 121. An agitator or impeller (not shown) extends into wash basket 120 and is also in mechanical communication with the motor. The impeller assists agitation of articles disposed within wash basket 120 during operation of washing machine appliance 100.

Cabinet 102 of washing machine appliance 100 has a top panel 140. Top panel 140 defines an opening 105 (FIG. 2) that permits user access to wash basket 120 of wash tub 121. Door 130, rotatably mounted to top panel 140, permits selective access to opening 105; in particular, door 130 selectively rotates between the closed position shown in FIG. 1 and the open position shown in FIG. 2. In the closed position, door 130 inhibits access to wash basket 120. Conversely, in the open position, a user can access wash basket 120. A window 136 in door 130 permits viewing of wash basket 120 when door 130 is in the closed position, e.g., during operation of washing machine appliance 100. Door 130 also includes a handle 132 that, e.g., a user may pull and/or lift when opening and closing door 130. Further, although door 130 is illustrated as mounted to top panel 140, alternatively, door 130 may be mounted to cabinet 102 or any other suitable support.

A control panel 110 with at least one input selector 112 (FIG. 1) extends from top panel 140. Control panel 110 and input selector 112 collectively form a user interface input for operator selection of machine cycles and features. A display 114 of control panel 110 indicates selected features, operation mode, a countdown timer, and/or other items of interest to appliance users regarding operation.

Operation of washing machine appliance 100 is controlled by a controller or processing device 108 (FIG. 1) that is operatively coupled to control panel 110 for user manipulation to select washing machine cycles and features. In response to user manipulation of control panel 110, controller 108 operates the various components of washing machine appliance 100 to execute selected machine cycles and features.

Controller 108 may include a memory and microprocessor, such as a general or special purpose microprocessor operable to execute programming instructions or micro-control code associated with a cleaning cycle. The memory may represent random access memory such as DRAM, or read only memory such as ROM or FLASH. In one embodiment, the processor executes programming instructions stored in memory. The memory may be a separate component from the processor or may be included onboard within the processor. Alternatively, controller 100 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software. Control panel 110 and other components of washing machine appliance 100 may be in communication with controller 108 via one or more signal lines or shared communication busses.

During operation of washing machine appliance 100, laundry items are loaded into wash basket 120 through opening 105, and washing operation is initiated through operator manipulation of input selectors 112. Wash basket 120 is filled with water and detergent and/or other fluid additives via a nozzle assembly 200, which will be described in detail below. One or more valves can be controlled by washing machine appliance 100 to provide for filling wash basket 120 to the appropriate level for the amount of articles being washed and/or rinsed. By way of example for a wash mode, once wash basket 120 is properly filled with fluid, the contents of wash basket 120 can be agitated (e.g., with an impeller as discussed previously) for washing of laundry items in wash basket 120.

After the agitation phase of the wash cycle is completed, wash basket 120 can be drained. Laundry articles can then be rinsed by again adding fluid to wash basket 120 depending on the specifics of the cleaning cycle selected by a user. The impeller may again provide agitation within wash basket 120. One or more spin cycles also may be used. In particular, a spin cycle may be applied after the wash cycle and/or after the rinse cycle to wring wash fluid from the articles being washed. During a spin cycle, wash basket 120 is rotated at relatively high speeds. After articles disposed in wash basket 120 are cleaned and/or washed, the user can remove the articles from wash basket 120, e.g., by reaching into wash basket 120 through opening 105.

Referring now generally to FIGS. 2 through 7, nozzle assembly 200 will be described in more detail according to various exemplary embodiments of the present subject matter. Although the discussion below refers to nozzle assembly 200, one skilled in the art will appreciate that the features and configurations described may be used for other fluid supply assemblies in other washing machine appliances as well. For example, nozzle assembly 200 may be positioned in another location within cabinet 102, may have a different water supply conduit configuration, and may dispense any suitable wash fluid or fluids such as water, detergent, other additives, or mixtures thereof. Other variations and modifications of the exemplary embodiment described below are possible, and such variations are contemplated as within the scope of the present subject matter.

As illustrated, nozzle assembly 200 generally includes an extendable nozzle 202 mounted to a retractable fluid supply conduit 204. More specifically, retractable fluid supply conduit 204 provides fluid communication between extendable or rotatable nozzle 202 and a valve assembly 206. In addition, valve assembly 206 is coupled to a supply of water or wash fluid and selectively provides a flow of wash fluid to extendable nozzle 202 so that a user may selectively dispense the wash fluid within wash tub 121. For example, according to the illustrated example embodiment of FIGS. 3 and 4, valve assembly 206 (and thus extendable nozzle 202) is directly coupled to a primary hot and cold water supply 207. Notably, retractable fluid supply conduit 204 is movable for positioning extendable nozzle 202 in a retracted position and an extended position, as described in more detail below. In this manner, extendable nozzle 202 may function as a primary fill nozzle in the retracted position and a spot treatment wand in the extended position.

Nozzle assembly 200 and its various components may be stored or mounted within cabinet 102 of washing machine appliance 100. For example, nozzle assembly 200 may be mounted directly under top panel 140 along the vertical direction V such that it is positioned between wash tub 121 and top panel 140. In this regard, for example, washing machine appliance 100 may define a nozzle housing 208 within which valve assembly 206, water supply conduit 204, and extendable nozzle 202 are at least partially positioned. For example, when extendable nozzle 202 is in the retracted position, only extendable nozzle 202 is visible to the user and extendable nozzle 202 can still supply wash fluid into tub 121. However, when extendable nozzle 202 is pulled out toward the extended position, extendable nozzle 202 and at least a portion of water supply conduit 204 are positioned outside nozzle housing 208, e.g., above wash tub 121 along the vertical direction V. Notably, maintaining the position of extendable nozzle 202 above the wash tub 121 ensures that wash fluid from within the wash tub 121 cannot be drawn back through extendable nozzle 202, e.g., into the water supply or leaked elsewhere within washing machine appliance 100.

Although the positioning and movement of nozzle assembly 200 is described herein according to exemplary embodiments, it should be appreciated that variations and modifications to the operation of nozzle assembly 200 may be made while remaining within the scope of the present subject matter. For example, FIG. 2 illustrates nozzle housing 208 and extendable nozzle 202 as being positioned along a back wall 210 and at a center of cabinet 102 along the transverse direction T. By contrast, according to the embodiment of FIGS. 6 and 7, nozzle housing 208 and extendable nozzle 202 are illustrated as being positioned along a back wall 210 of cabinet 102 at a corner 212 or lateral side along the lateral direction L. However, either embodiment may be positioned at any suitable location or locations within washing machine appliance 100.

Figure 3:
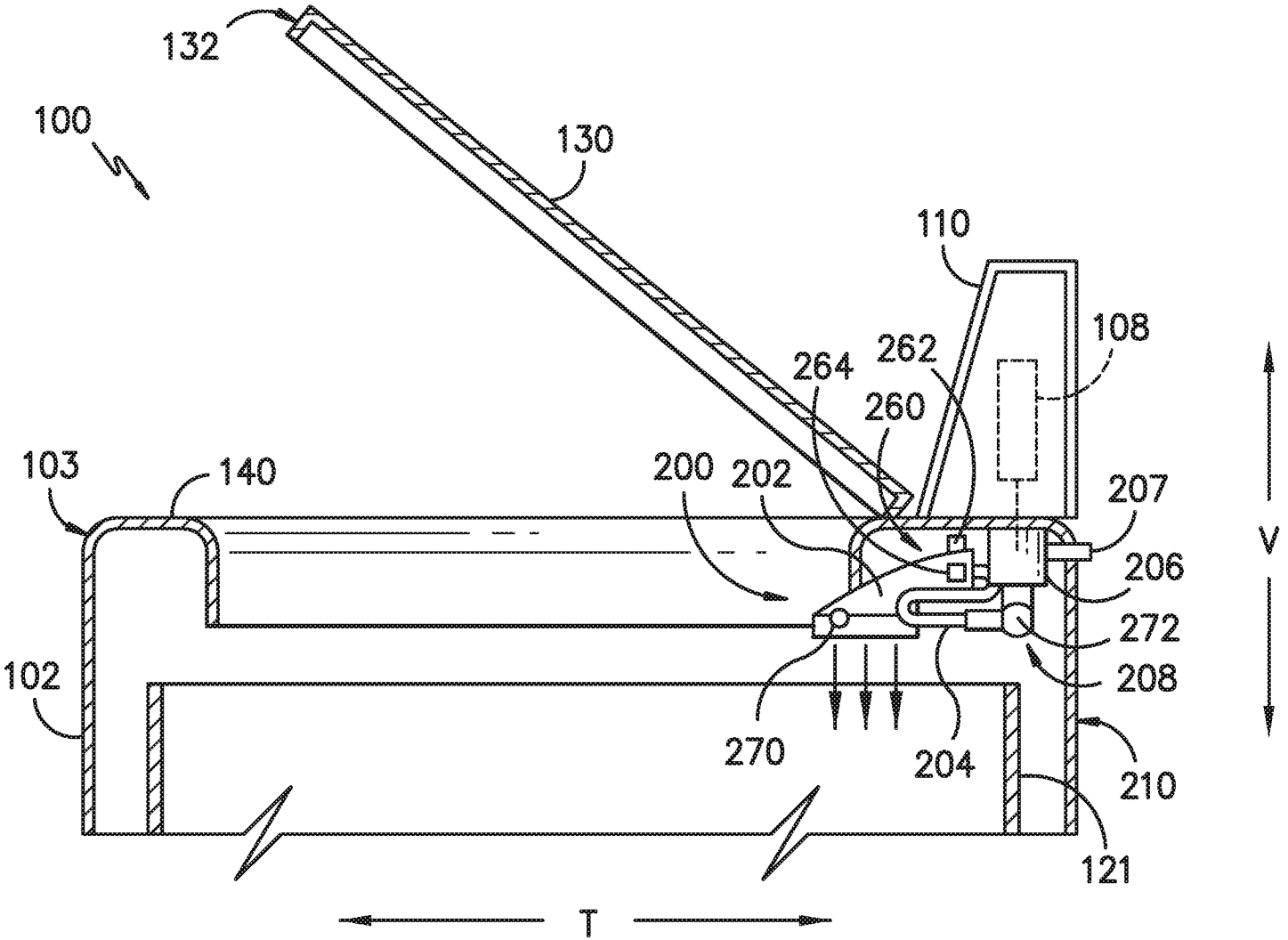
FIG. 3 provides a schematic side, cross-sectional view of a nozzle assembly of the exemplary washing machine appliance of FIG. 1 shown in a retracted position according to an exemplary embodiment of the present subject matter.
Figure 4:
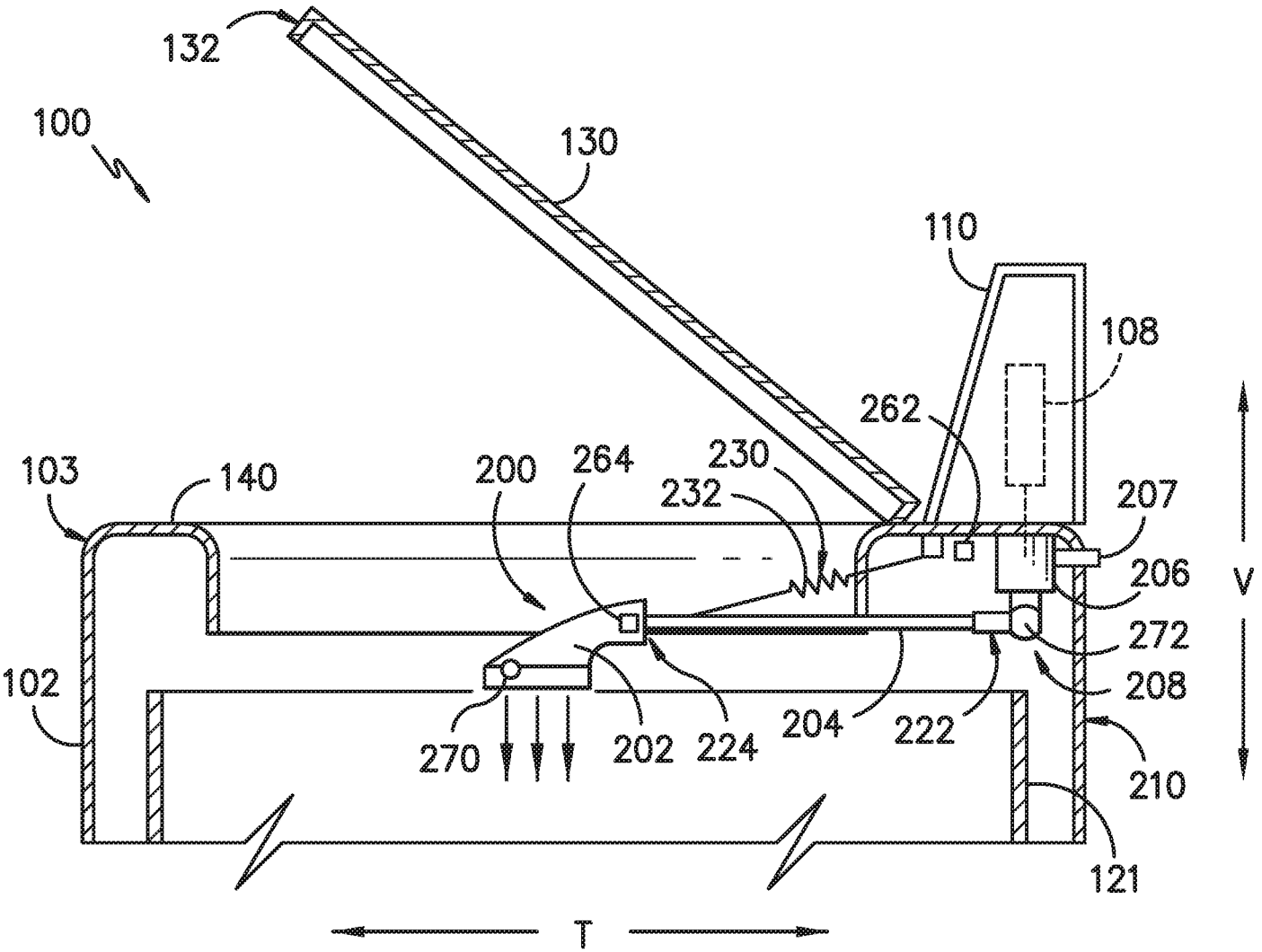
FIG. 4 provides a schematic side, cross-sectional view of the exemplary nozzle assembly of FIG. 3 shown in an extended position.
Figure 5:
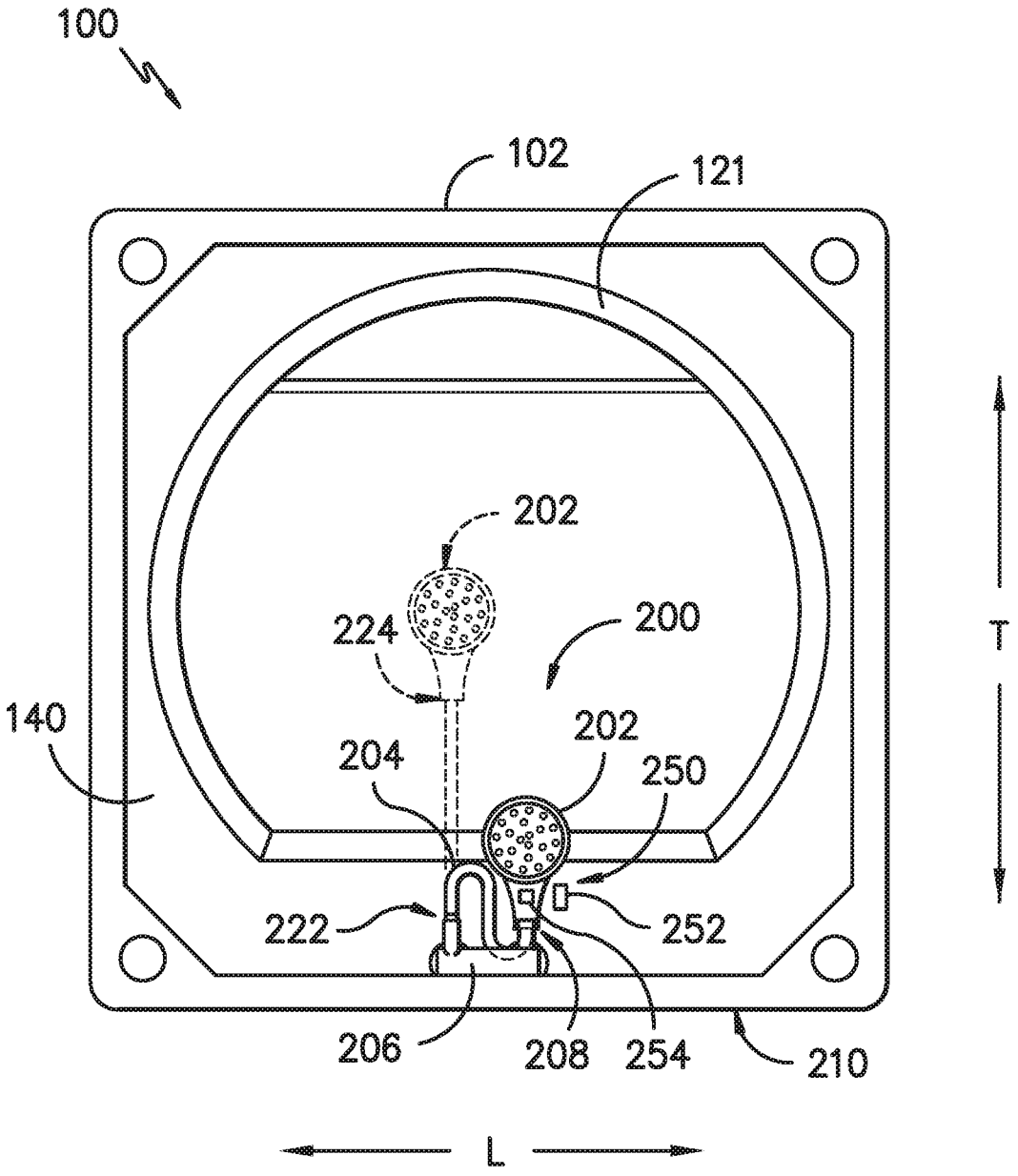
FIG. 5 provides a schematic top view of the exemplary nozzle assembly of FIG. 3 shown in both the extended position (in phantom) and the retracted position.

Referring now specifically to FIGS. 3 through 5, retractable fluid supply conduit 204 includes a flexible hose 220 having a first end 222 fluidly coupled to valve assembly 206 and a second end 224 fluidly coupled to extendable nozzle 202. Flexible hose 220 may be any size sufficient to provide wash fluid at the desired flow rate and may be any length suitable for providing a user with flexibility in directing wash fluid to desired portions of wash tub 121. For example, according to one exemplary embodiment, flexible hose 220 can extend along the entire depth of washing machine appliance 100 along the transverse direction T. Alternatively, according to the illustrated embodiment, flexible hose 220 may only extend about half way into wash tub 121 within a vertical plane (see FIG. 5). In this manner, the likelihood of extendable nozzle 202 spraying wash fluid outside of wash tub 121 is reduced.

In order to manage the length of flexible tube 220 when extendable nozzle 202 is in the retracted position, nozzle assembly 200 may further include a retraction mechanism 230 (FIG. 4). Retraction mechanism 230 may generally be any system or device that is configured for moving retractable fluid supply conduit 204, e.g., flexible hose 220, toward the retracted position. For example, as illustrated in FIG. 4, retraction mechanism 230 includes a mechanical spring 232 that extends from nozzle housing 208 to flexible hose 220 proximate extendable nozzle 202. In operation, when an operator pulls on extendable nozzle 202, mechanical spring 232 is stretched as flexible hose 220 is pulled out of nozzle housing 208. By contrast, when the operator releases extendable nozzle 202 after use, mechanical spring 232 retracts flexible hose 220 back into nozzle housing 208 and seats extendable nozzle 202 in its retracted position (see, e.g., FIGS. 2 and 3).

Although mechanical spring 232 is illustrated as extending between a fixed point on nozzle housing 208 to a specific position on flexible hose 220, it should be appreciated that the number, size, position, and orientation of mechanical spring 232 may vary according to alternative embodiments. For example, multiple mechanical springs 232 may be used and positioned at different orientations relative to flexible hose 220 to more efficiently and neatly retract flexible hose 220. Alternatively, other embodiments may use a weighted loop that includes a length of flexible hose 220 dropping down along the vertical direction V between wash tub 121 and cabinet 102 and having a weight attached for constantly urging extendable nozzle 202 toward the retracted position (e.g., in a manner similar to pull-down or pull-out kitchen faucets). According to still another embodiment, retraction mechanism 230 may be a coiling/or winding mechanism relying on a coil spring, an electric motor, or any other suitable mechanism for retracting flexible hose 220. In still another embodiment, flexible hose 220 is molded to include a spring action (e.g., spring memory) that urges extendable nozzle 202 to the retracted position. Other configurations are possible and within the scope of the present subject matter.

Figure 6:
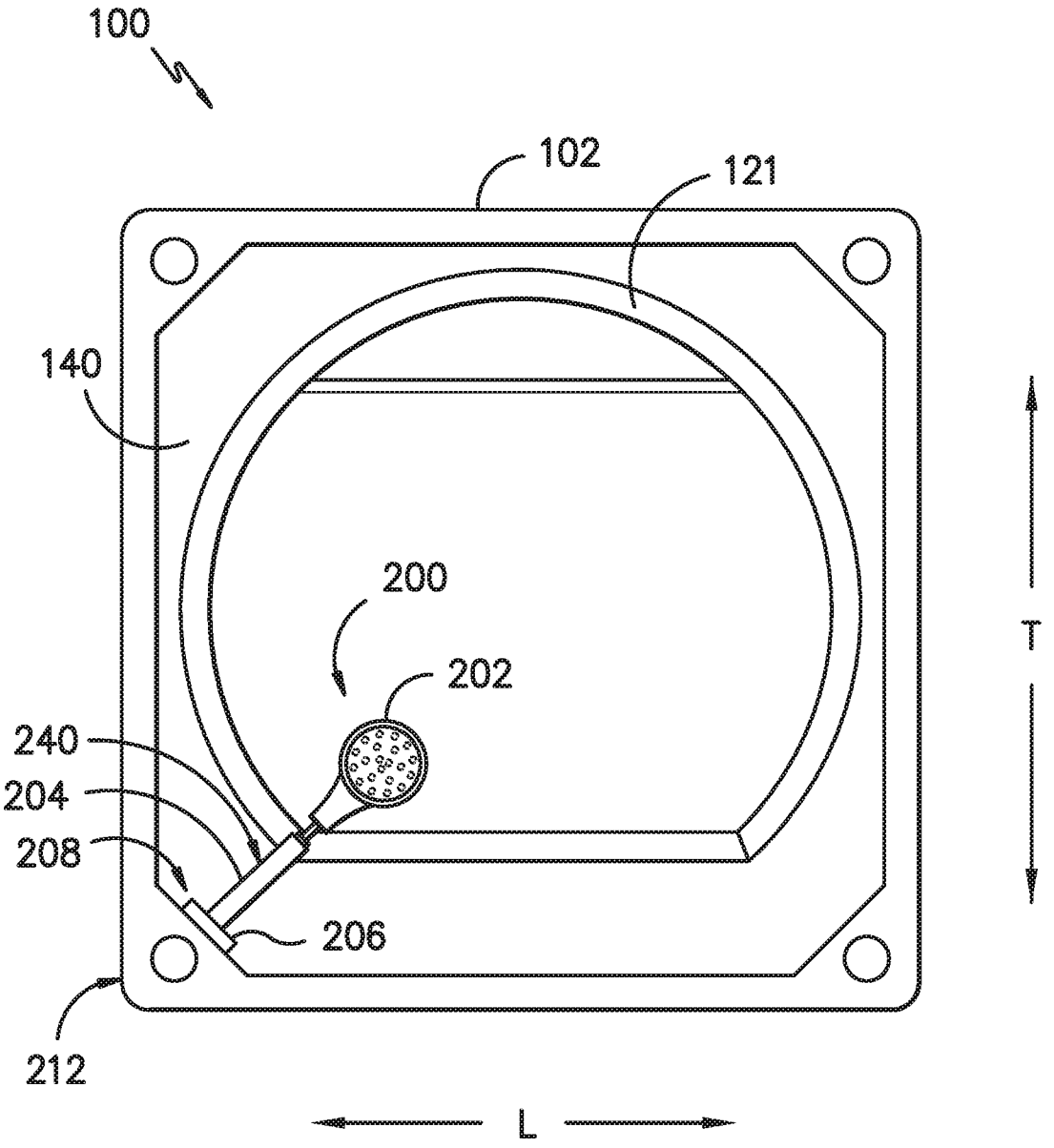
FIG. 6 provides a schematic top view of a nozzle assembly of the exemplary washing machine appliance of FIG. 1 shown in a retracted position according to another exemplary embodiment of the present subject matter.
Figure 7:
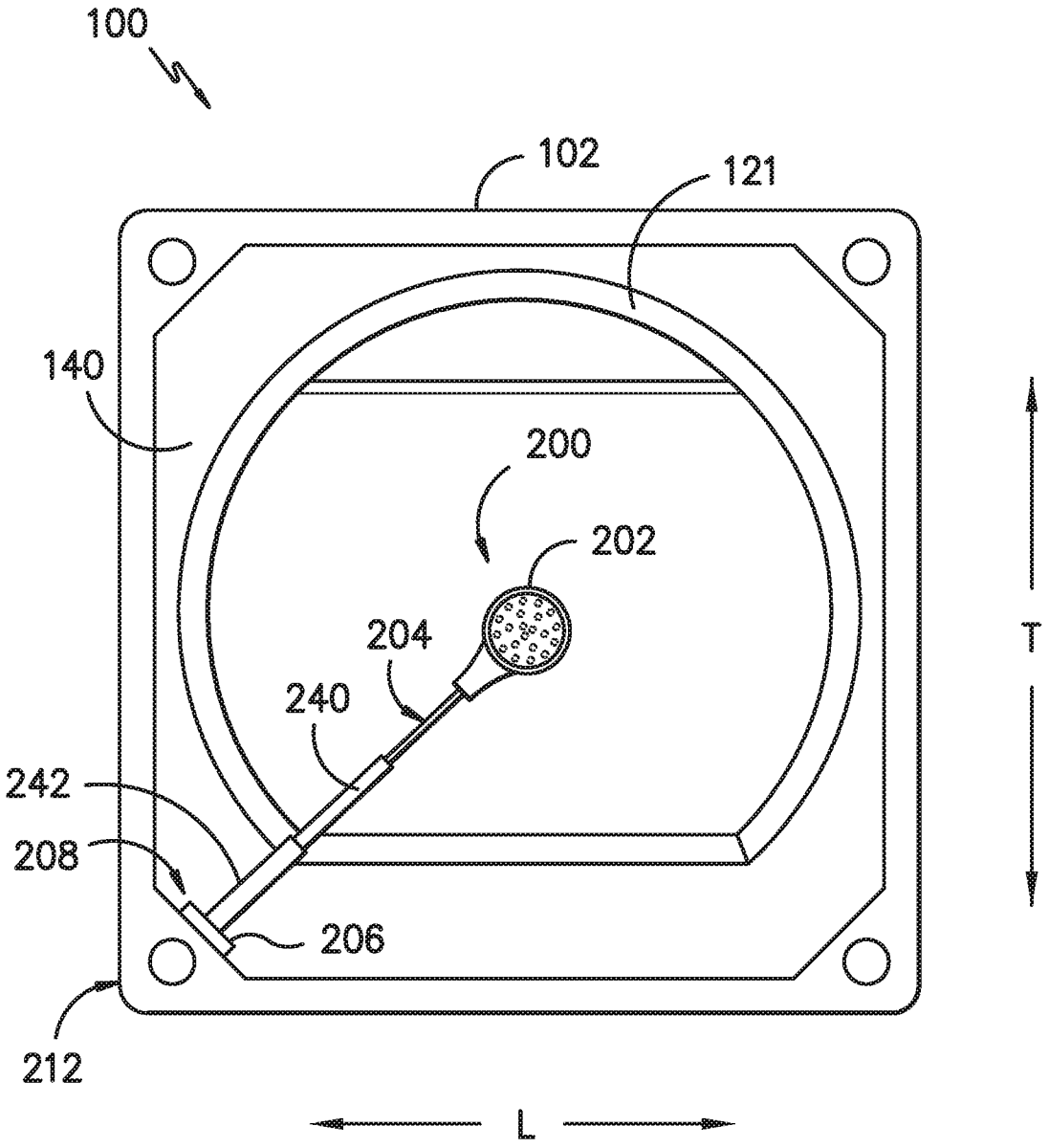
FIG. 7 provides a schematic top view of the exemplary nozzle assembly of FIG. 6 shown in an extended position.

Referring now to FIGS. 6 and 7, according to an alternative embodiment of the present subject matter, retractable water supply conduit 204 is a telescoping arm 240. As illustrated, telescoping arm 240 includes two or more telescoping sections 242 that are concentric to each other and may slide relative to each other as extendible nozzle 202 is moved between the extended position and the retracted position. According to the illustrated embodiment, telescoping sections 242 of telescoping arm 240 actually function as the fluid conduit for providing a flow of wash fluid to extendable nozzle 202. However, it should be appreciated that according to alternative embodiments, a flexible tube or conduit may be positioned within and supported by telescoping arm 240.

Notably, telescoping sections 242 engage each other such that telescoping arm 240 and extendable nozzle 202 extends only in a single vertical plane above wash tub 121. In this manner, the risk of dropping extendable nozzle 202 into wash tub 121 may be reduced or eliminated. In addition, a user may move extendable nozzle 202 to the extended position and then be free to use two hands underneath extendable nozzle 202, e.g., to, scrub, work, or clean an article of clothing. To further facilitate easy cleaning of articles of clothing, according to an exemplary embodiment, extendable nozzle 202 may include one or more lights, such as light emitting diodes (LEDs), positioned on extendable nozzle 202 and being configured for illuminating when extendable nozzle 202 is moved toward the extended position.

According to the illustrated embodiment, telescoping arm 240 includes three sections 242 and extends from a corner 212 of cabinet 102. In this manner, more space is provided to accommodate telescoping arm 240 and nozzle assembly 200 between wash tub 121 and cabinet 102. It should be appreciated that the size, position, number and size of sections 242, and general configuration of telescoping arm 240 may vary according to alternative embodiments. For example, telescoping arm could extend from the back center of cabinet 102. Alternatively, retractable fluid supply conduit 204 could be a fixed length arm that is connected in back corner 212 of cabinet 102 and pivots, e.g., pivots 45 degrees between a first position where extendable nozzle 202 is positioned at a back center of cabinet 102 to a second position where extendable nozzle 202 is positioned over a center of wash tub 121 within a vertical plane. Other configurations are possible and within the scope of the present subject matter.

Referring again to FIGS. 3 through 5, nozzle assembly 200 may further include a sensing system 250 for detecting whether extendable nozzle 202 is in the retracted position. In this regard, for example, sensing system 250 includes a hall-effect sensor 252 mounted at a fixed position within nozzle housing 208 and a magnet 254 positioned on second end 224 of flexible hose 220 or directly on extendable nozzle 202. In this manner, when extendable nozzle 202 is in the retracted position, hall-effect sensor 252 can detect the proximity of magnet 254 and controller 108 may determine that extendable nozzle 202 is in the retracted position. Alternatively, any other suitable sensors or methods of detecting the position of extendable nozzle 202 may be used. For example, motion sensors, camera systems, or simple mechanical contact switches may be used according to alternative embodiments.

According to exemplary embodiments, it may be desirable to temporarily lock extendable nozzle 202 in the retracted position, e.g., to prevent it from extending during operation of washing machine appliance 100. In this regard, for example, nozzle assembly 200 may further a locking mechanism 260 for locking extendable nozzle 202 in the retracted position. For example, as illustrated in FIGS. 3 and 4, locking mechanism 260 is a magnetic docking system including a first magnet 262 mounted at a fixed position within nozzle housing 208 and a second magnet 264 positioned on second end 224 of flexible hose 220 or directly on extendable nozzle 202. In this manner, when extendable nozzle 202 moves toward the retracted position, the magnetic attraction between first magnet 262 and second magnet 264 can draw and hold extendable nozzle 202 in the retracted position. Alternatively, any other suitable mechanism or methods of locking extendable nozzle 202 in the retracted position may be used. For example, a quarter-turn collar docking system, a push-to-release docking system, or a spring-ball quick-release system may be used according to alternative embodiments.

In some situations, a user may wish to add additional water to wash tub 121 or add a particular wash fluid for a pretreat operation. For example, a user may wish to prewash one or more articles of clothing or may perceive that more water is needed to effectively wash a load. In order to provide a user with control over the flow of wash fluid being dispensed through extendible nozzle 202, nozzle assembly 200 may further include one or more user input buttons 270 for adding a wash fluid to wash tub 121. User input buttons 270 may be operably coupled with controller 108 and/or valve assembly 206 for controlling the flow of wash fluid. According to the illustrated embodiment, user input button 270 is located on extendable nozzle 202 for easy access by an operator. However, according to alternative embodiments, user input button 270 may be positioned at any other suitable location or locations.

Referring again for example to FIGS. 3 and 4, valve assembly 206 generally includes a plurality of valves 272 configured to supply, for example, hot water, cold water, warm water, a mixture of water and wash fluid or detergent, other wash additives, etc. According to an exemplary embodiment, user input buttons 270 are configured for controlling one or more of valves 272 that can be turned on/off independently or together in any combination. Valves 272 may be, for example, solenoid valves that are electrically connected to controller 108. However, any other suitable water valve may be used to control the flow of water or wash fluid. Controller 108 may selectively open and close water valves 272 to allow water or wash fluid to flow from hot water inlet, cold water inlet, detergent inlet, softener inlet, or any other suitable fluid through a respective valve seat. Valve assembly 206 and/or nozzle housing 208 may further include a one or more detergent storage compartments, mixing chambers, or other features within which a fluid additive, e.g., powdered or liquid detergent, can mix with hot or cold water prior to being dispensed out of the extendable nozzle 202.

User input button 270 may be any button or switch suitable for providing an indication to controller 108 that a particular action should be initiated. For example, buttons 270 may be push button switches, toggle switches, rocker switches, or any other suitable tactile switch, such as capacitive touch buttons. According to the illustrated embodiments, buttons 270 are momentary switches (sometimes referred to as mom-off-mom switches). In this regard, buttons 270 are biased switches that return to their unlatched or unpressed state when released, e.g., by spring force.

It should be appreciated that the amount of water or wash fluid added to wash tub 121 upon pressing buttons 270 may vary depending on the application or wash cycle. Similarly, the amount of water delivered may be preset such that pressing buttons 270 delivers the predetermined amount of water. Alternatively, valves 272 may be configured to remain open at all times when corresponding buttons 270 are depressed. In this manner, a user may precisely control the amount of water added to wash tub 121.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A washing machine appliance defining a vertical, a lateral, and a transverse direction, the washing machine appliance comprising:
a cabinet;
a tub positioned within the cabinet;
a wash basket rotatably mounted within the tub, the wash basket defining a wash chamber for receiving articles for washing;
a nozzle assembly mounted within the cabinet and configured to provide wash fluid to the tub, the nozzle assembly comprising:
an extendable nozzle;
a valve assembly configured to provide a flow of wash fluid to the extendable nozzle; and
a retractable fluid supply conduit providing fluid communication between the valve assembly and the extendable nozzle, the retractable fluid supply being movable for positioning the extendable nozzle in a retracted position and an extended position such that the extendable nozzle translates within a horizontal plane, wherein the retractable fluid supply conduit is a flexible hose.

2. The washing machine appliance of claim 1, further comprising a retraction mechanism for moving the retractable fluid supply conduit toward the retracted position.

3. The washing machine appliance of claim 2, wherein the retraction mechanism is a spring.

4. The washing machine appliance of claim 1, wherein the retractable fluid supply conduit is directly coupled to a primary hot and cold water supply and functions as a primary fill nozzle of the washing machine appliance.

5. The washing machine appliance of claim 1, wherein the nozzle assembly further comprises a sensing system for detecting whether the extendable nozzle is in the retracted position.

6. The washing machine appliance of claim 5, wherein the sensing system comprises a hall-effect sensor and a magnet.

7. The washing machine appliance of claim 1, wherein the nozzle assembly further comprises a locking mechanism for locking the extendable nozzle in the retracted position.

8. The washing machine appliance of claim 7, wherein the locking mechanism is a magnetic docking system comprising a first magnet mounted at a fixed position within a nozzle housing and a second magnet positioned proximate the extendable nozzle.

9. The washing machine appliance of claim 1, wherein the nozzle assembly is positioned within a nozzle housing located underneath a top panel of the washing machine appliance.

10. The washing machine appliance of claim 1, wherein the extendable nozzle is positioned above the tub along the vertical direction.

11. The washing machine appliance of claim 1, wherein the extendable nozzle is positioned at a back wall of the cabinet.

12. The washing machine appliance of claim 1, wherein the extendable nozzle is positioned at a back corner of the cabinet.

13. The washing machine appliance of claim 1, wherein the nozzle assembly comprises a user input button for adding a wash fluid to the tub.

14. The washing machine appliance of claim 13, wherein the user input button is located on the extendable nozzle.

15. The washing machine appliance of claim 1, wherein the washing machine appliance is a vertical axis washing machine appliance.

16. A washing machine appliance defining a vertical, a lateral, and a transverse direction, the washing machine appliance comprising:
a cabinet;
a tub positioned within the cabinet;
a wash basket rotatably mounted within the tub, the wash basket defining a wash chamber for receiving articles for washing;
a nozzle assembly mounted within the cabinet and configured to provide wash fluid to the tub, the nozzle assembly comprising:
an extendable nozzle;
a valve assembly configured to provide a flow of wash fluid to the extendable nozzle; and
a retractable fluid supply conduit providing fluid communication between the valve assembly and the extendable nozzle, the retractable fluid supply being movable for positioning the extendable nozzle in a retracted position and an extended position such that the extendable nozzle translates within a horizontal plane; and
a sensing system comprising a hall-effect sensor and a magnet for detecting whether the extendable nozzle is in the retracted position.

17. The washing machine appliance of claim 16, wherein the retractable fluid supply conduit is a flexible hose.

18. The washing machine appliance of claim 16, further comprising:
a locking mechanism for locking the extendable nozzle in the retracted position, wherein the locking mechanism is a magnetic docking system comprising a first magnet mounted at a fixed position within a nozzle housing and a second magnet positioned proximate the extendable nozzle.

19. A washing machine appliance defining a vertical, a lateral, and a transverse direction, the washing machine appliance comprising:
a cabinet;
a tub positioned within the cabinet;
a wash basket rotatably mounted within the tub, the wash basket defining a wash chamber for receiving articles for washing;
a nozzle assembly mounted within the cabinet and configured to provide wash fluid to the tub, the nozzle assembly comprising:
an extendable nozzle;
a valve assembly configured to provide a flow of wash fluid to the extendable nozzle; and
a retractable fluid supply conduit providing fluid communication between the valve assembly and the extendable nozzle, the retractable fluid supply being movable for positioning the extendable nozzle in a retracted position and an extended position such that the extendable nozzle translates within a horizontal plane; and
a user input button located on the extendable nozzle for adding a wash fluid to the tub.

20. The washing machine appliance of claim 19, wherein the retractable fluid supply conduit is a flexible hose.

* * * * *